US011324383B2

(12) United States Patent
Lee et al.

(10) Patent No.: US 11,324,383 B2
(45) Date of Patent: May 10, 2022

(54) NOZZLE AND DISHWASHER INCLUDING THE SAME

(71) Applicant: Samsung Electronics Co., Ltd., Suwon-si (KR)

(72) Inventors: Chang Wook Lee, Suwon-si (KR); Eun Seok Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 113 days.

(21) Appl. No.: 16/701,615

(22) Filed: Dec. 3, 2019

(65) Prior Publication Data

US 2020/0178753 A1 Jun. 11, 2020

(30) Foreign Application Priority Data

Dec. 5, 2018 (KR) ..... 10-2018-0154881

(51) Int. Cl.
*A47L 15/42* (2006.01)
*B05B 1/06* (2006.01)

(52) U.S. Cl.
CPC ..... *A47L 15/428* (2013.01); *A47L 15/4282* (2013.01); *B05B 1/06* (2013.01); *A47L 2501/20* (2013.01)

(58) Field of Classification Search
CPC ..... A47L 15/428; A47L 15/4282; A47L 2501/20; A47L 15/23; A47L 15/4278; B05B 1/06
See application file for complete search history.

(56) References Cited

U.S. PATENT DOCUMENTS

| | | | | |
|---|---|---|---|---|
| 1,825,033 A | 9/1931 | Walker | | |
| 2014/0130833 A1* | 5/2014 | Ryu | ..... | A47L 15/22 134/172 |

FOREIGN PATENT DOCUMENTS

| | | | | |
|---|---|---|---|---|
| CN | 201357120 Y | 12/2009 | | |
| CN | 204122274 | 1/2015 | | |
| DE | 10 2013 105 979 A1 | 12/2014 | | |
| EP | 2 730 208 A1 | 5/2014 | | |
| JP | 2006-20894 | 1/2006 | | |
| KR | 10-1994-0023533 | 11/1994 | | |
| KR | 10-2002-0020112 | 3/2002 | | |
| KR | 2002-0020112 A | 3/2002 | | |
| KR | 20020020112 A * | 3/2002 | | |
| KR | 10-1137786 | 4/2012 | | |
| KR | 20120140680 A * | 12/2012 | ..... | A47L 15/4282 |

(Continued)

OTHER PUBLICATIONS

NPL-1 https://www.lorric.com/en/Products/Nozzles/SPP (Year: 2016).*

(Continued)

*Primary Examiner* — Michael E Barr
*Assistant Examiner* — Pallavi Chitta
(74) *Attorney, Agent, or Firm* — Staas & Halsey LLP

(57) ABSTRACT

A dishwasher including a nozzle capable of widening an injection region of washing water includes a main body, a washing tub provided inside the main body, and a nozzle configured to inject washing water into the inside of the washing tub, wherein the nozzle includes an injection port through which the washing water is injected, a guide portion configured to spirally guide the washing water injected through the injection port, and a leg portion configured to connect the guide portion and the injection port.

20 Claims, 16 Drawing Sheets

(56) References Cited

FOREIGN PATENT DOCUMENTS

| | | |
|---|---|---|
| KR | 10-2014-0066857 | 6/2014 |
| KR | 10-2014-0140262 | 12/2014 |

OTHER PUBLICATIONS

International Search Report dated Apr. 9, 2020 in International Patent Application No. PCT/KR2019/017130.
Extended European Search Report dated Oct. 29, 2021 from European Application No. 19894274.0.

* cited by examiner

NOZZLE AND DISHWASHER INCLUDING THE SAME

CROSS-REFERENCE TO RELATED APPLICATIONS

This application is based on and claims priority under 35 U.S.C. § 119 to Korean Patent Application No. 10-2018-0154881, filed on Dec. 5, 2018, in the Korean Intellectual Property Office, the disclosure of which is incorporated by reference herein in its entirety.

BACKGROUND

1. Field

The disclosure relates to a dishwasher, and more particularly, to a nozzle capable of widening a washing region and a dishwasher including the same.

2. Description of the Related Art

In general, a dishwasher includes a main body provided with a washing chamber therein, a rack disposed inside a washing tub to receive tableware, a plurality of nozzles, a sump unit installed below the washing tub to collect water used for washing and to be supplied to the nozzles, and the like.

The rack may include an upper rack and a lower rack disposed vertically, and the nozzle may include an upper nozzle disposed above the upper rack to inject water toward the tableware received in the upper rack, a lower nozzle disposed below the lower rack to inject water toward the tableware received in the lower rack, a middle nozzle disposed between the upper rack and the lower rack to simultaneously inject water onto the tableware received in the upper rack and the lower rack, and the like.

Each of the nozzles may include an injection port for injecting water. In general, the injection port may be formed to be inclined with respect to one surface of the nozzle to inject water toward a predetermined direction.

Water injected through the injection port may be injected in a substantially straight line. When water is injected in a substantially straight line, the range in which water is injected may be limited. When the range in which water is injected is limited, the washing region of the dishwasher may be limited.

SUMMARY

It is an aspect of the disclosure to provide a dishwasher including a nozzle capable of widening a region in which washing water is injected.

Additional aspects of the disclosure will be set forth in part in the description which follows and, in part, will be obvious from the description, or may be learned by practice of the disclosure.

In accordance with an aspect of the disclosure, a dishwasher includes a main body, a washing tub provided inside the main body, and a nozzle configured to inject washing water into the inside of the washing tub, wherein the nozzle includes an injection port through which the washing water is injected, a guide portion configured to spirally guide the washing water injected through the injection port, and a leg portion configured to connect the guide portion and the injection port.

The nozzle may include a plurality of holes formed by the guide portion and the leg portion, and the plurality of holes may be disposed in different directions to allow the washing water to be injected in various directions.

The plurality of holes and the injection port may be disposed to be spaced apart from each other vertically.

The guide portion may be formed in a spiral shape in which a distance with a central axis of the guide portion is gradually closer.

The guide portion may include a guide surface configured to guide the washing water by coming into contact with the washing water, and the guide surface may be configured to be inclined toward a radially outer side of the injection port.

The leg portion may include a plurality of the leg portions disposed to be spaced apart along a circumferential direction of the injection port.

The plurality of leg portions may include a first leg portion, a second leg portion provided to be longer than the first leg portion, and a third leg portion provided to be longer than the second leg portion.

The distance between the guide portion and the injection port may increase as the guide portion approaches a central axis of the guide portion.

The dishwasher may further include a rack disposed in the washing tub, a lower rotating nozzle disposed below the rack and configured to be rotatable, an upper rotating nozzle disposed above the rack and configured to be rotatable, a middle rotating nozzle disposed between the lower rotating nozzle and the upper rotating nozzle and configured to be rotatable, and an auxiliary nozzle configured to restrictively inject water into a partial region of the rack.

The nozzle may be provided on at least one of the lower rotating nozzle, the upper rotating nozzle, the middle rotating nozzle, and the auxiliary nozzle.

The leg portion may include a first leg portion provided on one side of the injection port, and a second leg portion provided on the other side facing the one side of the injection port.

The guide portion may include a guide hole configured to inject the washing water injected through the injection port in a direction parallel to a central axis of the guide portion.

The thickness of the guide portion in a radial direction of the guide hole may be provided to gradually become thinner along a circumferential direction of the guide hole.

In accordance with another aspect of the disclosure, a dishwasher includes a main body, a washing tub provided inside the main body, and a rotating nozzle including a nozzle to inject washing water in a spiral shape and configured to be rotatable about a rotating axis positioned outside the nozzle, wherein the nozzle includes an injection port through which the washing water is injected, and a guide portion to increase the number of injection directions of the washing water to widen an injection region of the washing water injected through the injection port.

The guide portion may include a guide hole configured to inject the washing water injected through the injection port in a direction parallel to a central axis of the guide portion.

The thickness of the guide portion in a radial direction of the guide hole may be provided to gradually become thinner along a circumferential direction of the guide hole.

The guide portion may be formed in a spiral shape converging toward the central axis of the guide portion.

The guide portion may include a guide surface configured to guide the washing water by coming into contact with the washing water, and the guide surface may be configured to be inclined toward a radially outer side of the injection port.

The distance between the guide portion and the injection port may be provided to gradually decrease along a circumferential direction of the injection port.

In accordance with another aspect of the disclosure, a nozzle, which is configured to inject washing water into a washing tub of a dishwasher, includes an injection port through which the washing water is injected, a guide portion disposed to be spaced apart from the injection port and configured to spirally guide the washing water injected through the injection port, and a leg portion configured to connect the guide portion and the injection port.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
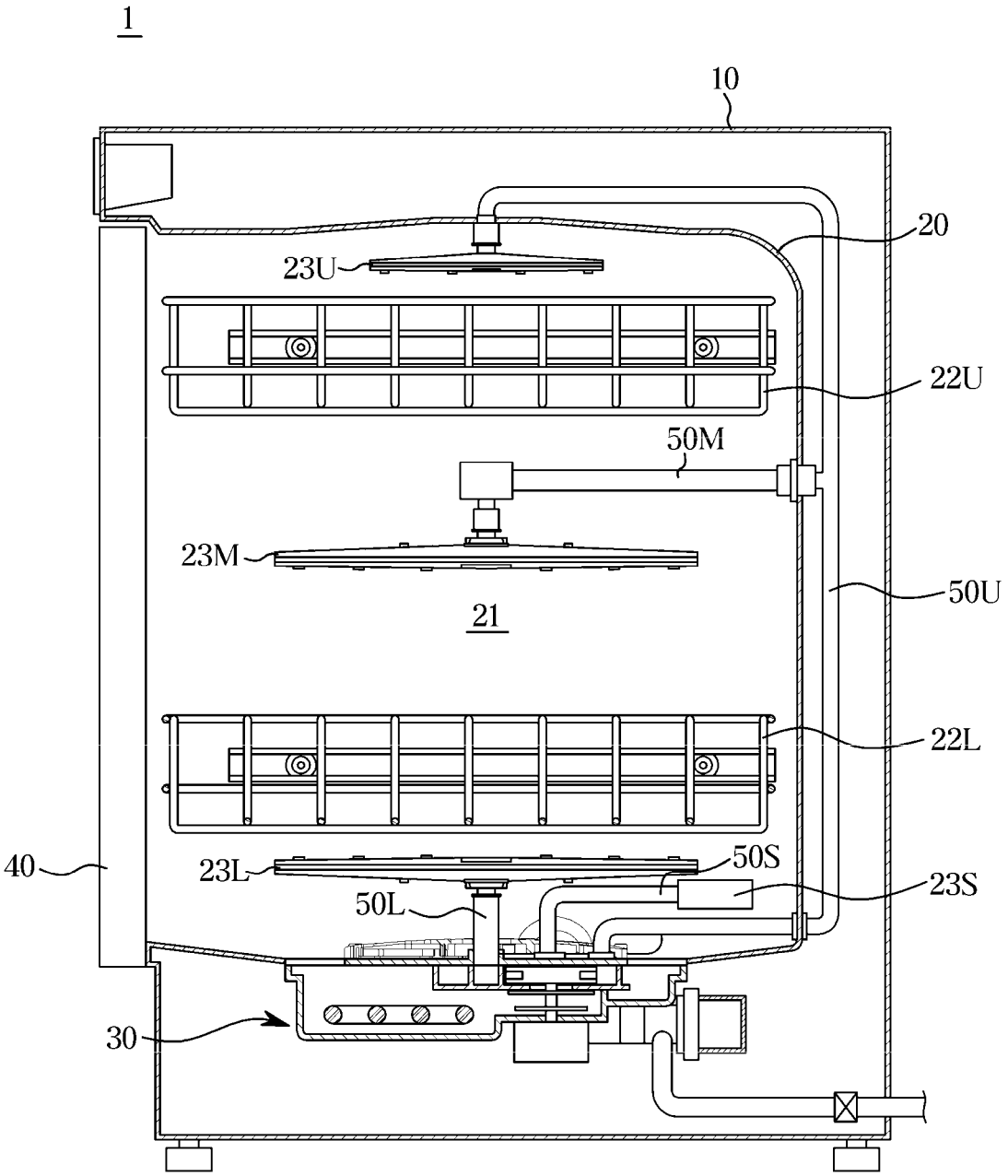
FIG. 1 is a cross-sectional view of a dishwasher according to an embodiment of the disclosure.

The embodiments described herein and the configurations shown in the drawings are only examples of embodiments of the disclosure, and various modifications may be made at the time of filing of the disclosure to replace the embodiments and drawings of the present specification.

The terms used herein are for the purpose of describing the embodiments and are not intended to restrict and/or to limit the disclosure. For example, the singular expressions herein may include plural expressions, unless the context clearly dictates otherwise. Also, the terms "comprises" or "has" are intended to indicate that there are features, numbers, steps, operations, elements, parts, or components thereof described in the specification, and do not exclude the presence or addition of one or more other features, numbers, steps, operations, elements, parts, or components thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component.

Hereinafter embodiments of the disclosure will be described in detail with reference to the accompanying drawings.

Figure 2:
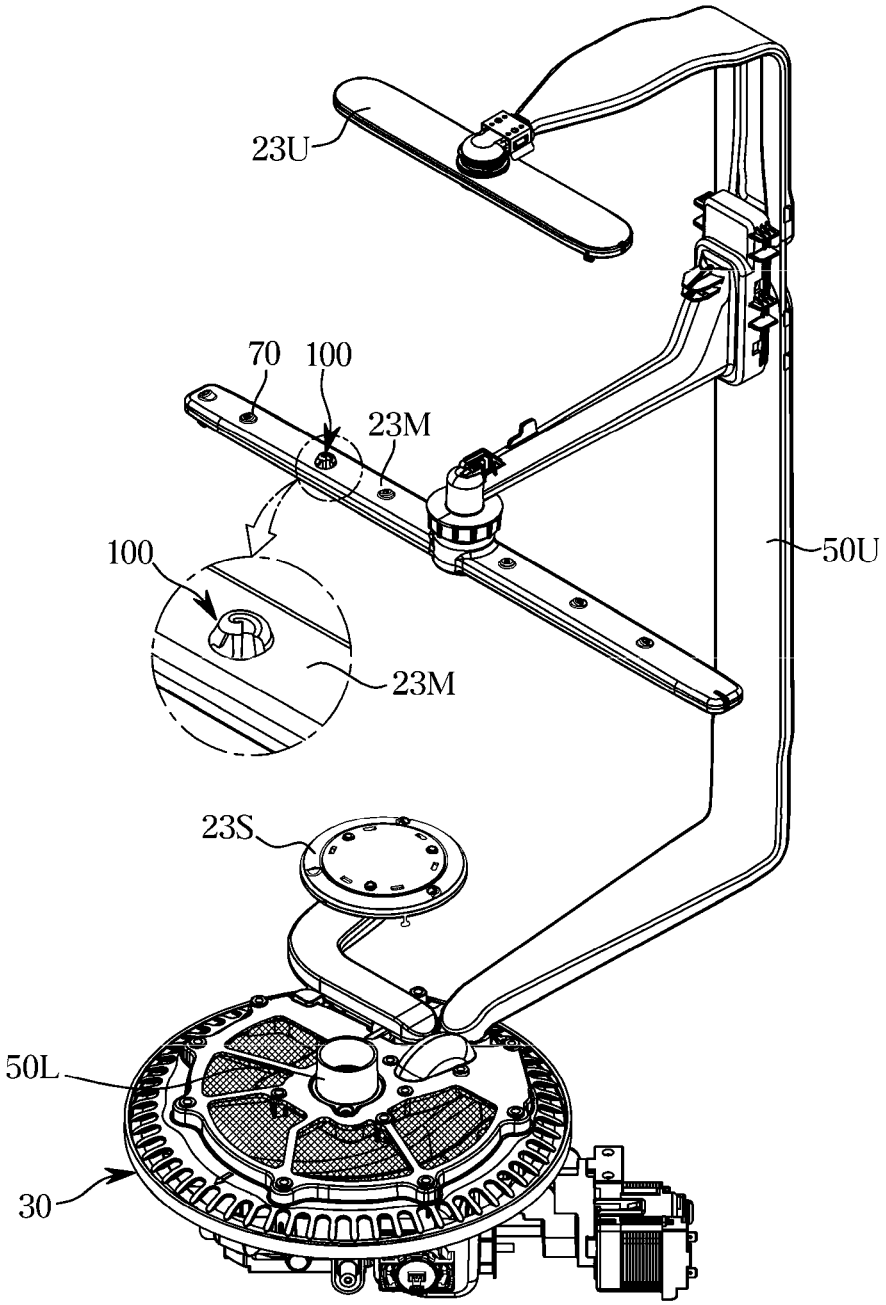
FIG. 2 is a perspective view illustrating an arrangement of a sump unit and nozzles in the dishwasher according to an embodiment of the disclosure.

FIG. 1 is a cross-sectional view of a dishwasher according to an embodiment of the disclosure, and FIG. 2 is a perspective view illustrating an arrangement of a sump unit and nozzles in the dishwasher according to an embodiment of the disclosure.

As illustrated in FIG. 1, a dishwasher 1 according to an embodiment of the disclosure may include a main body 10 forming an outer appearance, a washing tub 20 provided inside the main body 10 and forming a washing chamber 21 in which washing of tableware is performed, a sump unit 30 provided below the washing tub 20 to collect water used for washing, and a door 40 to open and close an open front side of the washing tub 20.

The washing tub 20 is provided with a pair of racks 22U and 22L disposed vertically to receive the tableware; respectively, and a plurality of rotating nozzles 23U, 23M and 23L and an auxiliary nozzle 23S to inject the water delivered from the sump unit 30 toward the tableware received in the pair of racks 22U and 22L.

The pair of racks 22U and 22L may include the upper rack 22U disposed at an upper portion of the washing chamber 21 and the lower rack 22L disposed at a lower portion of the washing chamber 21. The rotating nozzles 23U, 23M and 23L may include the upper rotating nozzle 23U disposed above the upper rack 22U to inject washing water downward, the lower rotating nozzle 231 disposed below the lower rack 22L to inject washing water upward, and the middle rotating nozzle 23M disposed between the upper rack 22U and the lower rack 22L to inject washing water up and down. Each of the rotating nozzle 23U, 23M, 23L may be provided to be rotatable. The rotating nozzle 23U, 23M, 23L may widen a washing region by injecting water while rotating and may minimize the region where water does not reach in the washing region.

The auxiliary nozzle 23S may be disposed at one side of the lower portion of the washing chamber 21 to inject washing water into a partial region of the lower rack 22L. The auxiliary nozzle 23S may be fixed not to rotate unlike the rotating nozzles 23U, 23M, and 23L. However, the disclosure is not limited thereto, and the auxiliary nozzle 23S may be provided to be rotatable within a predetermined range.

The upper rotating nozzle 23U may wash the tableware received in the upper rack 22U by injecting water downward, and the lower rotating nozzle 23L may wash the tableware received in the lower rack 22L by injecting water upward. The middle rotating nozzle 23M may simultaneously wash the tableware received in the upper rack 22U and the tableware received in the lower rack 22L by injecting water upward and downward. The auxiliary nozzle 23S, which injects washing water into a partial region of the lower rack 22L, is designed to inject relatively high pressure water compared to other rotating nozzles 23U, 23M, and 23L, so that the tableware heavily contaminated in the corresponding region may be intensively washed.

The sump unit 30 may be disposed at the center of the bottom of the washing tub 20 to perform a function to collect washing water used for washing.

The sump unit 30 may include an upper flow passage 50U to guide water to the upper rotating nozzle 23U, a lower flow passage 50L having one end connected to the sump unit 30 and the other end connected to the lower rotating nozzle 23L to guide the water discharged from the sump unit 30 to the lower rotating nozzle 23L, an auxiliary flow passage 50S having one end connected to the sump unit 30 and the other end connected to the auxiliary nozzle 23S to guide the water discharged from the sump unit 30 to the auxiliary nozzle 23S, and a middle flow passage 50M connecting the upper flow passage 50U and the middle rotating nozzle 23M to guide a part of the water passing through the upper flow passage 50U to the middle rotating nozzle 23M.

Referring to FIG. 2, the middle rotating nozzle 23M may include an injection port 70 to inject washing water. A plurality of the injection ports 70 may be provided. The plurality of injection ports 70 may be provided not only on the middle rotating nozzle 23M but also on the upper rotating nozzle 23U, the lower rotating nozzle 23L, and the auxiliary nozzle 23S.

Conventionally, the washing water injected through an injection port is injected in only one predetermined direction. As the washing water is injected in one direction, the injection region of the washing water is limited, so that the tableware may not be washed as a whole. In other words, conventionally, the washing region of a nozzle is limited.

According to the disclosure, the injection region of the washing water injected from the injection port may be widened by providing a nozzle in the injection port. Accordingly, the entirety of the tableware, rather than a partial region of the tableware, may be effectively washed. In other words, the washing region of the nozzle may be widened.

A nozzle 100 according to an embodiment of the disclosure may be applied without limitation wherever the injection port is provided. As illustrated in FIG. 2, the nozzle 100 may be applied to the injection port 70 of the middle rotating nozzle 23M. FIG. 2 illustrates that the nozzle 100 is applied to any one of the injection ports 70 of the middle rotating nozzle 23M, but the number and arrangement of the nozzles 100 may be changed. The nozzle 100 may also be formed together with the injection port on at least one of the upper rotating nozzle 23U, the lower rotating nozzle 23L, and the auxiliary nozzle 23S. In addition, although not shown in the drawings, the above configuration may be applied to a linear type dishwasher. Hereinafter a case where the nozzle 100 according to an embodiment of the disclosure is provided on the auxiliary nozzle 23S will be described as an example.

Figure 3:
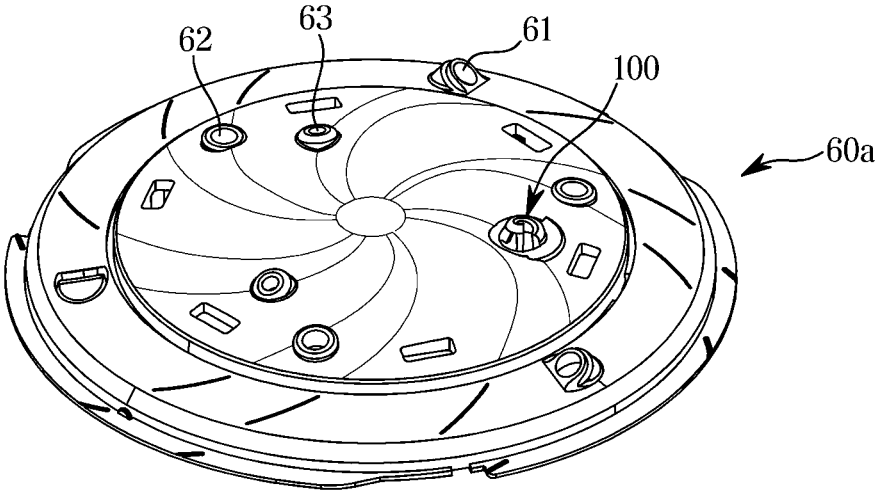
FIG. 3 is a perspective view of an auxiliary nozzle plate in the dishwasher according to an embodiment of the disclosure.
Figure 4:
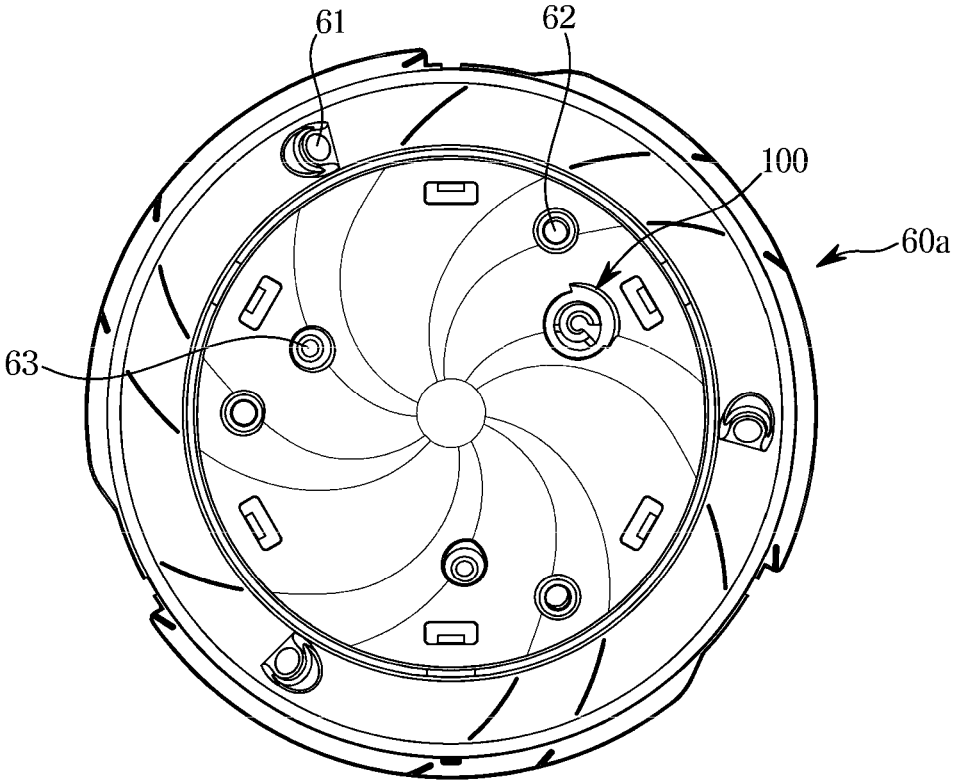
FIG. 4 is a plane view of the auxiliary nozzle plate in the dishwasher according to an embodiment of the disclosure.

FIG. 3 is a perspective view of an auxiliary nozzle plate in the dishwasher according to an embodiment of the disclosure, and FIG. 4 is a plane view of the auxiliary nozzle plate in the dishwasher according to an embodiment of the disclosure.

According to an embodiment of the disclosure, the auxiliary nozzle 23S may include an auxiliary nozzle plate 60*a*. The auxiliary flow passage 50S may be connected to a lower portion of the auxiliary nozzle plate 60*a* to receive water from the sump unit 30.

The auxiliary nozzle plate 60*a* may include a plurality of injection ports 61, 62, and 63. The auxiliary nozzle plate 60*a* may include the first injection port 61 disposed to be spaced apart along an outer circumference of the auxiliary nozzle plate 60*a*, the second injection port 62 disposed closer to a central axis of the auxiliary nozzle plate 60*a* than the first injection port 61, and the third injection port 63 disposed closer to the central axis of the auxiliary nozzle plate 60*a* than the second injection port 62. The second injection port 62 and the third injection port 63 may be disposed to be spaced apart along a circumferential direction of the auxiliary nozzle plate 60*a*, respectively.

The first injection port 61 may be disposed to be inclined at a predetermined angle with respect to the auxiliary nozzle plate 60*a*. The first injection port 61 may inject washing water to be inclined at the predetermined angle with respect to the auxiliary nozzle plate 60*a*. The washing water injected through the first injection port 61 may be injected only in a limited region. The injection region of the washing water injected through the first injection port 61 may be limited.

Like the first injection port 61, the second injection port 62 and the third injection port 63 may inject washing water only in a narrow region.

According to the disclosure, the dishwasher 1 may include the nozzle 100 to widen the injection region of the washing water injected from the injection port. Although the drawing illustrates that the nozzle 100 is provided on the third injection port 63, the disclosure is not limited thereto. The nozzle 100 may also be provided on the first injection port 61 and/or the second injection port 62.

Figure 5:
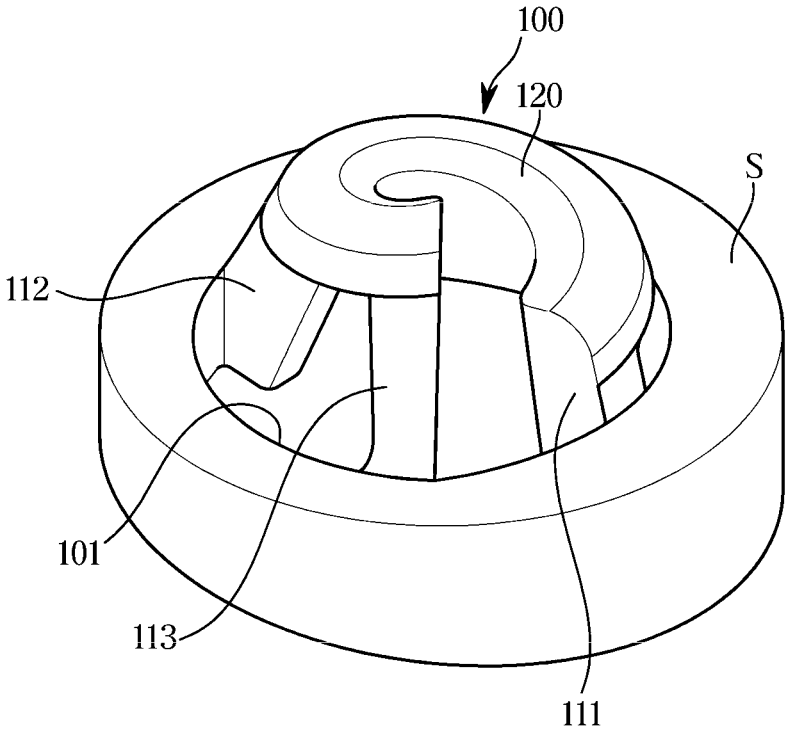
FIG. 5 is a perspective view of the nozzle in the dishwasher according to an embodiment of the disclosure.
Figure 6:
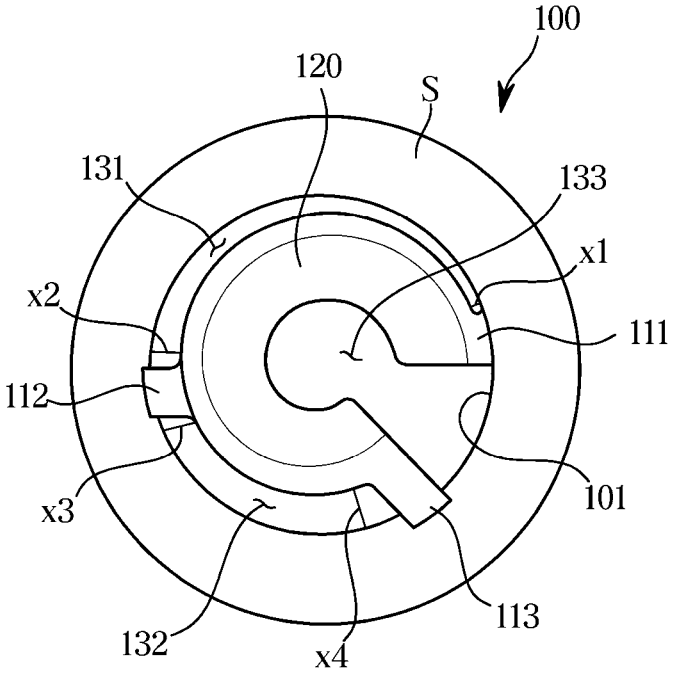
FIG. 6 is a plane view of the nozzle in the dishwasher according to an embodiment of the disclosure.
Figure 7:
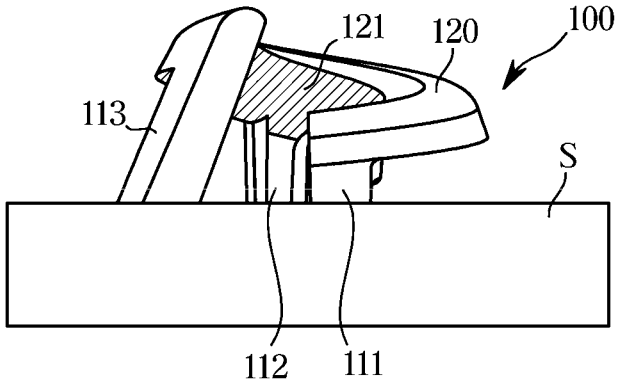
FIGS. 7 to 10 are side views illustrating the nozzle at various angles in the dishwasher according to an embodiment of the disclosure.
Figure 8:
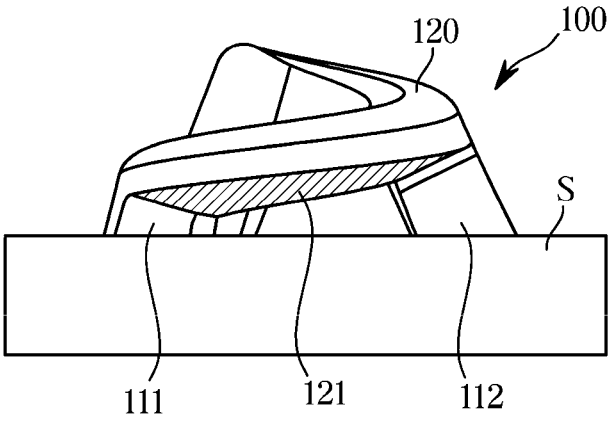
Figure 9:
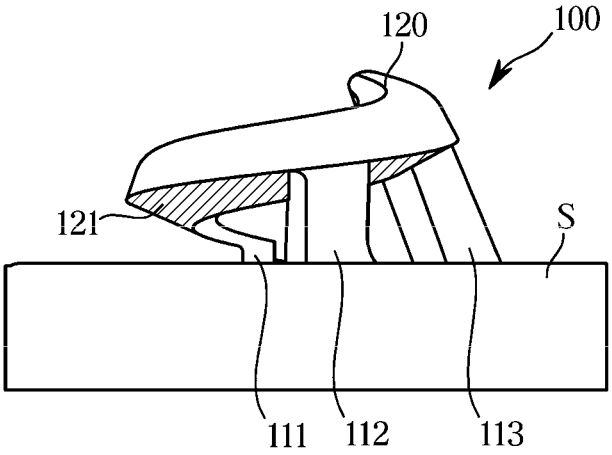
Figure 10:
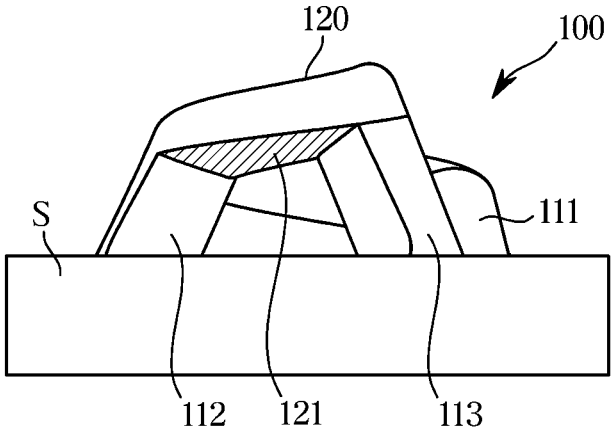

FIG. 5 is a perspective view of the nozzle in the dishwasher according to an embodiment of the disclosure. FIG. 6 is a plane view of the nozzle in the dishwasher according to an embodiment of the disclosure. FIGS. 7 to 10 are side views illustrating the nozzle at various angles in the dishwasher according to an embodiment of the disclosure;

Hereinafter the nozzle of the dishwasher according to an embodiment of the disclosure will be described with reference to FIGS. 5 to 10.

The nozzle 100 according to an embodiment of the disclosure may be provided on a region S of the dishwasher 1. The region S of the dishwasher 1 may include one region of the nozzles 23U, 23M, 23L, and 23S described above and may also include one region of the washing chamber 21. Hereinafter the region S of the dish washing machine is referred to as the nozzle surface S.

The nozzle 100 may include an injection port 101 provided to penetrate the nozzle surface S. The nozzle 100 may be provided to be fitted to the nozzle surface S. For example, the nozzle 100 may be separately manufactured and fitted into a predetermined hole (not shown) provided in the nozzle surface S. Alternatively, the nozzle 100 may be formed integrally with the nozzle surface S.

The injection port 101 may receive water from the sump unit 30. The water discharged from the sump unit 30 may be introduced into the injection port 101. The water introduced into the injection port 101 may be injected into the washing chamber 21 through the injection port 101.

The nozzle 100 may include a guide portion 120 to spirally guide the washing water injected through the injection port 101. The nozzle 100 may include leg portions 111, 112, and 113 to connect the guide portion 120 and the injection port 101.

The guide portion 120 may be formed in a spiral shape that converges toward a central axis of the guide portion 120. The guide portion 120 may be formed in a spiral shape that rotates about the central axis of the guide portion 120. The guide portion 120 may also be provided to converge toward the central axis of the guide portion 120 as the guide portion 120 moves away from the nozzle surface S. In other words, the guide portion 120 may be formed to be closer to the central axis of the guide portion 120 as the guide portion 120 rotates.

The guide portion 120 may widen the injection region of the washing water injected through the injection port 101. Specifically, the guide portion 120 may increase the number of injection directions of the washing water injected through the injection port 101. The guide portion 120 may implement diversification of the injection direction of the washing water. As the number of injection directions of the washing water increases, the injection region of the washing water injected through the injection port 101 may be widened.

The guide portion 120 may include a guide surface 121 provided to come into contact with the washing water injected through the injection port 101. The guide surface 121 may refer to a lower surface of the guide portion 120. The guide surface 121 may come into contact with the washing water to guide the washing water.

The guide surface 121 may be provided to be inclined toward the outside of the guide portion 120. In other words, the guide surface 121 may be provided to be inclined toward a radially outer side of the injection port 101.

The guide surface 121 may be provided to be inclined upward toward the outside of the guide portion 120. The washing water injected through the injection port 101 may be injected in a direction of being inclined upward toward the outside of the guide portion 120 by the guide surface 121. As described above, because the guide portion 120 is provided in a spiral shape, the washing water may be spirally injected. When the washing water is injected in a spiral shape, the injection region of the washing water may be widened.

The leg portions 111, 112, and 113 may include the first leg portion 111, the second leg portion 112, and the third leg portion 113 disposed to be spaced apart from each other along a circumferential direction of the injection port 101.

The first leg portion 111 may connect one end of the guide portion 120 and the injection port 101. The third leg portion 113 may connect the other end of the guide portion 120 and the injection port 101.

The second leg portion 112 may be provided to be longer than the first leg portion 111. The third leg portion 113 may be provided to be longer than the second leg portion 112. Because the distance between the guide portion 120 and the injection port 101 gradually increases, the lengths of the leg portions 111, 112, and 113 connecting the guide portion 120 and the injection port 101 may also gradually increase.

The leg portions 111, 112, and 113 may be provided to be inclined toward the central axis of the guide portion 120. This is because the size of the injection port 101 is larger than the guide portion 120. The guide portion 120 may be disposed to be spaced apart from the injection port 101 to cover one region of the injection port 101.

The nozzle 100 may include a first hole 131 formed between the first leg portion 111, the second leg portion 112, and the guide portion 120, a second hole 132 formed between the second leg portion 112, the third leg portion 113, and the guide portion 120, and a third hole 133 formed between the third leg portion 113, the first leg portion 111, and the guide portion 120.

According to the disclosure, as the nozzle 100 includes the guide portion 120 and the leg portions 111, 112, and 113, the number of injection ports through which washing water is injected and the directions in which washing water is injected may increase.

According to an embodiment of the disclosure, the injection port 101 may include the first hole 131, the second hole 132, and the third hole 133. The first hole 131 may allow the washing water to be injected in a first direction. The second hole 132 may allow the washing water to be injected in a second direction different from the first direction. The third hole 133 allow the washing water to be injected in a third direction different from the first and second directions. The washing water may be injected in various directions through the first hole 131, the second hole 132, and the third hole 133. Through this, the injection region of the washing water injected from the nozzle 100 may be widened.

The first hole 131 may be provided to gradually increase along the circumferential direction of the injection port 101. In other words, the distance between the guide portion 120 and the injection port 101 may be provided to gradually increase along the circumferential direction of the injection port 101. Referring to FIG. 6, a width x2 at the other end of the first hole 131 may be larger than a width x1 at one end of the first hole 131.

The second hole 132 may be provided to gradually increase along the circumferential direction of the injection port 101. In other words, the distance between the guide portion 120 and the injection port 101 may be provided to gradually increase along the circumferential direction of the injection port 101. Referring to FIG. 6, a width x4 at the other end of the second hole 132 may be larger than a width x3 at one end of the second hole 132.

The third leg portion 113 and the first leg portion 111 may not be connected by the guide portion 120. The guide portion 120 may not form a closed curve. The guide portion 120 may be formed in the form of an open curve between the first leg portion 111 and the third leg portion 113. The third hole 133 may refer to an open region between the first leg portion 111 and the third leg portion 113.

Figure 11:
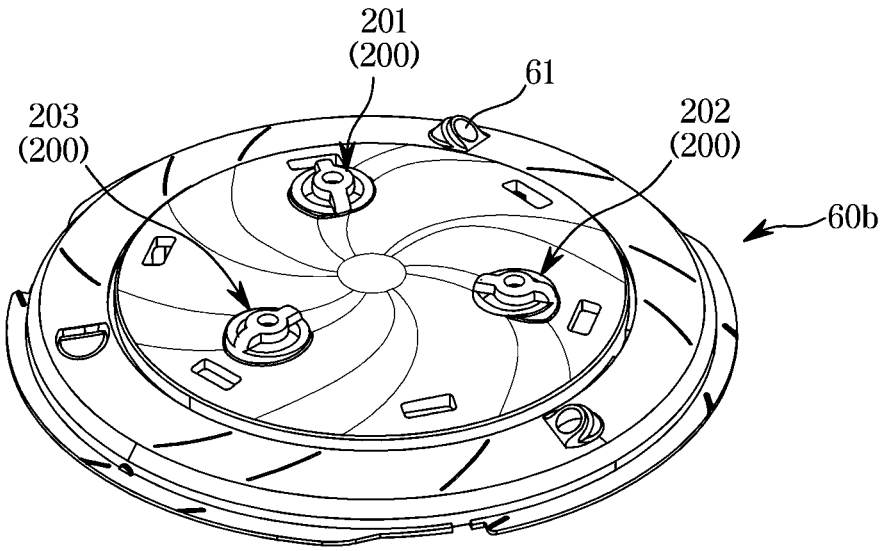
FIG. 11 is a perspective view of an auxiliary nozzle plate in a dishwasher according to another embodiment of the disclosure.
Figure 12:
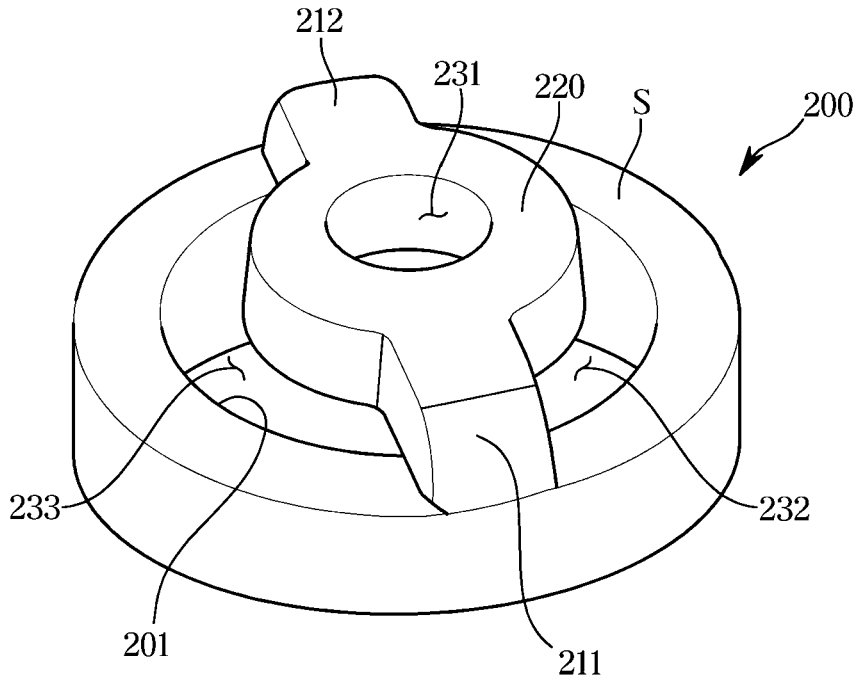
FIG. 12 is a perspective view of a nozzle in a dishwasher according to another embodiment of the disclosure.
Figure 13:
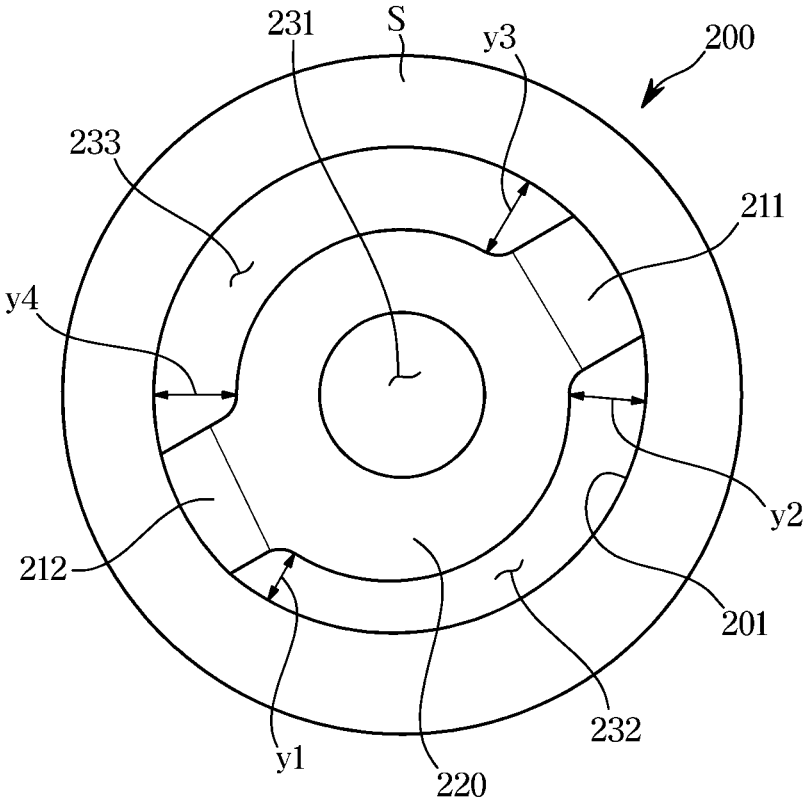
FIG. 13 is a bottom view of the nozzle in the dishwasher according to another embodiment of the disclosure.

FIG. 11 is a perspective view of an auxiliary nozzle plate in a dishwasher according to another embodiment of the disclosure. FIG. 12 is a perspective view of a nozzle in a dishwasher according to another embodiment of the disclosure. FIG. 13 is a bottom view of the nozzle in the dishwasher according to another embodiment of the disclosure.

An auxiliary nozzle plate **60*b* in a dishwasher according to another embodiment of the disclosure may include the first injection port 61. The auxiliary nozzle plate 60*b* may include a plurality of injection ports 201 disposed closer to a central axis of the auxiliary nozzle plate 60*b* than the first injection port 61. A plurality of nozzles 200 may be provided in the plurality of injection ports 201**.

The plurality of nozzles 200 may be disposed on the auxiliary nozzle plate **60*b* in different directions. However, the disclosure is limited thereto. Only one nozzle may be provided on the auxiliary nozzle plate 60*b***.

Referring to FIGS. 12 and 13, the nozzle 200 may include a guide portion 220 provided to cover at least a portion of the injection port 201, and leg portions 211 and 212 provided to connect the guide portion 220 and the injection port 201.

The guide portion 220 may include a guide hole 231 provided to inject the washing water injected through the injection port 201 in a direction parallel to a central axis of the guide portion 220. The guide hole 231 may be provided to penetrate the center of the guide portion 220.

The leg portions 211 and 212 may include the first leg portion 211 provided at one side of the injection port 201 and the second leg portion 212 provided at the other side facing the one side of the injection port 201. In other words, the first leg portion 211 and the second leg portion 212 may be disposed on a straight line.

The thickness of the guide portion 220 may be provided to vary along a circumferential direction of the guide hole 231. Specifically, the thickness of the guide portion 220 in a radial direction of the guide hole 231 may be provided to gradually become thinner along the circumferential direction of the guide hole 231.

Referring to FIG. 13, the guide portion 220 may be provided in a spiral shape. As described above, the guide portion 220 may be provided in a spiral shape by gradually varying the thickness of the guide portion 220.

The distance between the guide portion 220 and the injection port 201 may be provided to gradually increase along the circumferential direction of the injection port 201. The nozzle 200 may include a first hole 232 and a second hole 233 provided between the guide portion 220 and the injection port 201. A width y1 of one end of the first hole 232 may be provided to be smaller than a width y2 of the other end of the first hole 232. A width y3 of one end of the second hole 233 may be provided to be smaller than a width y4 of the other end of the second hole 233. In other words, the distance between the guide portion 220 and the injection port 201 may be provided to gradually increase along the circumferential direction of the injection port 201.

According to the disclosure, the nozzle 200 may inject washing water through the guide hole 231, the first hole 232, and the second hole 233. The guide hole 231 may allow the washing water to be injected at a high pressure by having a diameter smaller than that of the injection port 201. In addition, the first hole 232 and the second hole 233 may widen the injection region of the washing water by allowing the washing water to be sprayed in various directions.

Figure 14:
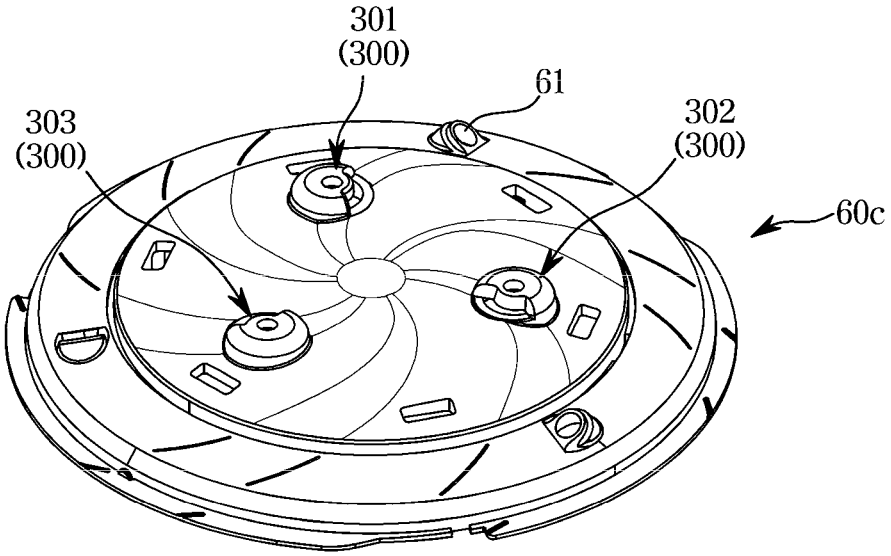
FIG. 14 is a perspective view of an auxiliary nozzle plate in a dishwasher according to another embodiment of the disclosure.
Figure 15:
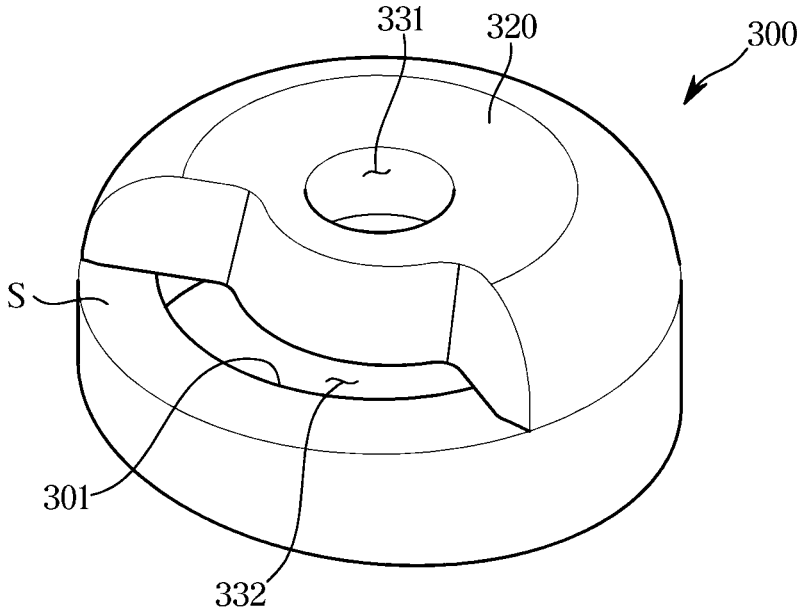
FIG. 15 is a perspective view of a nozzle in a dishwasher according to another embodiment of the disclosure.
Figure 16:
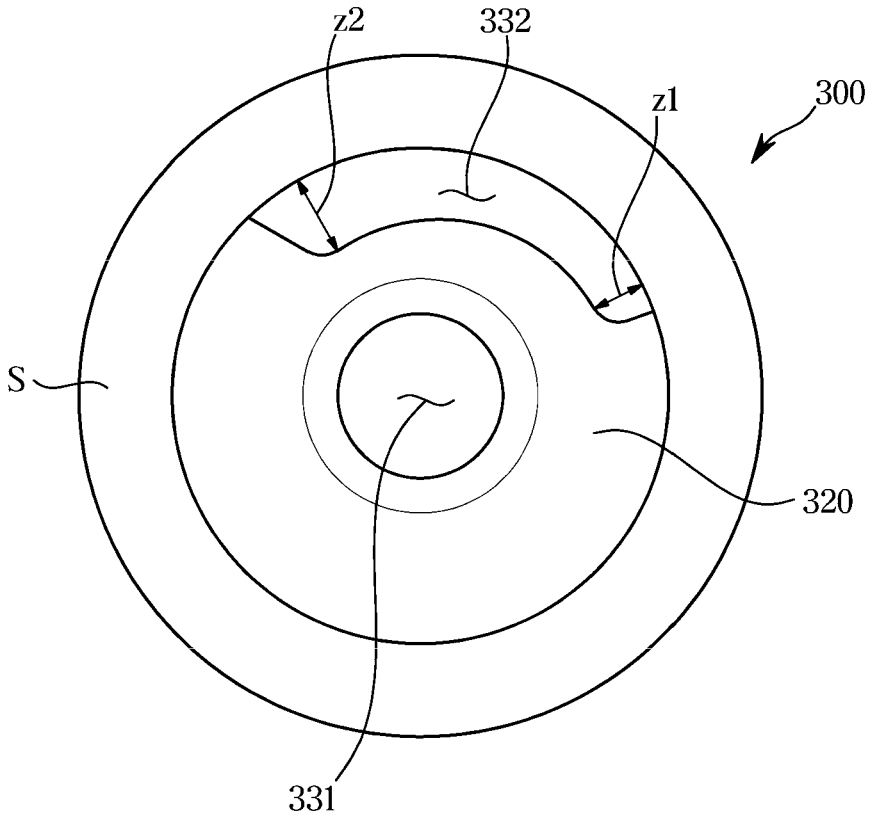
FIG. 16 is a bottom view of the nozzle in the dishwasher according to another embodiment of the disclosure.

FIG. 14 is a perspective view of an auxiliary nozzle plate in a dishwasher according to another embodiment of the disclosure. FIG. 15 is a perspective view of a nozzle in a dishwasher according to another embodiment of the disclosure. FIG. 16 is a bottom view of the nozzle in the dishwasher according to another embodiment of the disclosure.

Hereinafter a nozzle of a dishwasher according to another embodiment of the disclosure will be described with reference to FIGS. 14 to 16.

According to another embodiment of the disclosure, an auxiliary nozzle plate 60*c* may include the first injection port 61 disposed on an outer circumference of the auxiliary nozzle plate 60*c*. A nozzle 300 may be formed together with an injection port 301 disposed closer to a central axis of the auxiliary nozzle plate 60*c* than the first injection port 61. However, the disclosure is not limited thereto, and the nozzle 300 may be provided at various positions.

Referring to FIGS. 15 and 16, the nozzle 300 according to another embodiment of the disclosure may include a cover portion 320 provided to cover the injection port 301. The cover portion 320 may be provided to cover at least a portion of the injection port 301.

The cover portion 320 may include a guide hole 331 provided to penetrate the cover portion 320. The guide hole 331 may guide inject the washing water injected through the injection port 301 in a first direction. The first direction may refer to a direction parallel to a central axis of the injection port 301.

The nozzle 300 may include a spiral hole 332 formed between the cover portion 320 and the nozzle surface S. The spiral hole 332 which is a portion of the injection port 301 may refer to a region not covered by the cover portion 320.

The spiral hole 332 may be provided such that the width thereof gradually varies along a circumferential direction of the injection port 301. Specifically, the length of the spiral hole 332 in a radial direction of the injection port 301 may gradually increase along the circumferential direction of the injection port 301. Referring to FIG. 16, a width z1 of one end of the spiral hole 332 may be provided to be smaller than a width z2 of the other end of the spiral hole 332. Through this, the washing water may be injected at a relatively high pressure at one end of the spiral hole 332 and may be injected at a relatively low pressure at the other end of the spiral hole 332.

As described above, the nozzle 300 may cover at least a portion of the injection port 301 and may include the guide hole 331 and the spiral hole 332 provided to allow the washing water to be injected in different directions. Through this, the nozzle 300 may have a wider injection region as compared to injecting the washing water directly through the injection port 301.

As is apparent from the above, according to the disclosure, a dishwasher including a nozzle capable of widening a region in which washing water is injected can be provided.

Although a few embodiments of the disclosure have been shown and described, it would be appreciated by those skilled in the art that changes may be made in these embodiments without departing from the principles and spirit of the disclosure in the scope of which is defined in the claims and their equivalents.

The invention claimed is:

1. A dishwasher comprising:

a main body;

a washing tub provided inside the main body; and a nozzle configured to inject washing water into the washing tub, the nozzle including:

an injection port configured to inject the washing water into the washing tub, a guide downstream of the injection port and configured to spirally guide the washing water injected from the injection port, and at least two legs extending between the injection port and the guide to connect the guide to the injection port, and configured so that the washing water flows between the at least two legs.

2. The dishwasher according to claim 1, wherein the nozzle further includes a plurality of holes defined by the guide, the injection port and the at least two legs, and the plurality of holes are disposed in different directions to inject the washing water in various directions.

3. The dishwasher according to claim 2, wherein the plurality of holes and the injection port are spaced apart from each other in a downstream direction.

4. The dishwasher according to claim 1, wherein the guide has a spiral shape in which a radius of the guide is gradually decreased.

5. The dishwasher according to claim 1, wherein the guide includes a guide surface configured to guide the washing water by contacting the washing water, and the guide surface is inclined toward an outer circumference of the injection port.

6. The dishwasher according to claim 1, wherein the at least two legs include a plurality of legs spaced apart along a circumferential direction of the injection port.

7. The dishwasher according to claim 6, wherein the plurality of legs includes a first leg, a second leg which is longer than the first leg, and a third leg longer than the second leg.

8. The dishwasher according to claim 1, wherein a distance between the guide and the injection port increases as the guide approaches a central axis of the guide in a downstream direction.

9. The dishwasher according to claim 1, further comprising a rack disposed in the washing tub, a lower rotating nozzle disposed below the rack and configured to be rotatable, an upper rotating nozzle disposed above the rack and configured to be rotatable, a middle rotating nozzle disposed between the lower rotating nozzle and the upper rotating nozzle and configured to be rotatable, and an auxiliary nozzle configured to inject water towards only a portion of the rack.

10. The dishwasher according to claim 9, wherein the nozzle is provided on at least one of the lower rotating nozzle, the upper rotating nozzle, the middle rotating nozzle, and the auxiliary nozzle.

11. The dishwasher according to claim 1, wherein the at least two legs include a first leg on a first side of the injection port, and a second leg on a second side of the injection port facing the first side of the injection port.

12. The dishwasher according to claim 11, wherein the guide includes a guide hole configured to inject the washing water injected through the injection port in a direction parallel to a central axis of the guide.

13. The dishwasher according to claim 12, wherein a width of a portion of the guide forming the guide hole gradually decreases along a circumferential direction of the guide hole.

14. A dishwasher comprising:

a main body;

a washing tub provided inside the main body; and a rotating nozzle including a nozzle configured to inject washing water in a spiral shape and configured to be rotatable about an axis of rotation outside the nozzle, the nozzle including:

an injection port configured to inject the washing water into the washing tub, a guide configured to increase a number of injection directions of the washing water; and at least two legs extending between the injection port and the guide and configured so that the washing water flows between the at least two legs.

15. The dishwasher according to claim 14, wherein the guide includes a guide hole configured to inject the washing water injected through the injection port in a direction parallel to a central axis of the guide.

16. The dishwasher according to claim 15, wherein a width of a portion of the guide forming the guide hole gradually decreases along a circumferential direction of the guide hole.

17. The dishwasher according to claim 14, wherein the guide has a spiral shape converging toward a central axis of the guide.

18. The dishwasher according to claim 14, wherein the guide includes a guide surface configured to guide the washing water by contacting the washing water, and the guide surface is configured to be inclined toward an outer circumference of the injection port.

19. The dishwasher according to claim 14, wherein a distance between the guide and the injection port gradually decreases along a circumferential direction of the injection port.

20. A nozzle configured to inject washing water into a washing tub of a dishwasher, the nozzle comprising:

an injection port configured to inject the washing water into the washing tub;

a guide spaced apart from the injection port in a downstream direction from the injection port and configured to guide the washing water injected from the injection port; and at least two legs extending between the injection port and the guide to connect the guide to the injection port.

* * * * *